US009803868B2

(12) United States Patent
Moehrle et al.

(10) Patent No.: US 9,803,868 B2
(45) Date of Patent: Oct. 31, 2017

(54) THERMALLY COMPLIANT SUPPORT FOR A COMBUSTION SYSTEM

(75) Inventors: Frank Moehrle, Palm City, FL (US); John Pula, Jupiter, FL (US); Jeremy Lefler, Stuart, FL (US); Martin Konen, Palm Beach Gardens, FL (US)

(73) Assignee: Siemens Energy, Inc., Orlando, FL (US)

( * ) Notice: Subject to any disclaimer, the term of this patent is extended or adjusted under 35 U.S.C. 154(b) by 1712 days.

(21) Appl. No.: 13/241,443

(22) Filed: Sep. 23, 2011

(65) Prior Publication Data

US 2012/0291452 A1 Nov. 22, 2012

Related U.S. Application Data

(60) Provisional application No. 61/488,207, filed on May 20, 2011.

(51) Int. Cl.

| | |
|---|---|
| ***F23R 3/60*** | (2006.01) |
| ***F23R 3/10*** | (2006.01) |
| ***F23R 3/46*** | (2006.01) |

(52) U.S. Cl.

CPC ..... *F23R 3/60* (2013.01); *F23R 3/10* (2013.01); *F23R 3/46* (2013.01); *F23R 2900/03342* (2013.01)

(58) Field of Classification Search

CPC .... F01D 9/023; F02C 7/20; F23R 3/60; F23R 3/002

USPC ..... 60/39.12–39.19, 200.1, 201, 227, 39.01, 60/39.21–39.3, 39.08–39.11, 228–269, 60/224–226.3, 39.3–39.465, 39.64, 60/39.821–39.83, 722–806, 39.47–39.59, 60/39.6–39.81, 202–223; 137/15.1–15.2; 239/127.1, 127.3, 265.11–265.43

See application file for complete search history.

(56) References Cited

U.S. PATENT DOCUMENTS

| | | | | |
|---|---|---|---|---|
| 2,795,108 | A * | 6/1957 | Saldin | 60/796 |
| 5,083,424 | A * | 1/1992 | Becker | 60/796 |
| 5,274,991 | A | 1/1994 | Fitts | |
| 6,438,959 | B1 | 8/2002 | Dean et al. | |
| 6,923,002 | B2 | 8/2005 | Crawley et al. | |
| 7,614,236 | B2 * | 11/2009 | Mandet et al. | 60/766 |
| 7,661,273 | B2 * | 2/2010 | Commaret et al. | 60/799 |
| 2006/0230763 | A1 | 10/2006 | Johnson et al. | |
| 2009/0056337 | A1 | 3/2009 | Commaret et al. | |

(Continued)

FOREIGN PATENT DOCUMENTS

| | | |
|---|---|---|
| EP | 1577505 A2 | 9/2005 |
| EP | 2031303 A1 | 3/2009 |

*Primary Examiner* — Ehud Gartenberg
*Assistant Examiner* — Thomas Burke

(57) ABSTRACT

A support structure in a gas turbine combustor end cap (24) including a bracket (60) with a first leg (61) and a second leg (62) forming a generally trapezoidal geometry. Each leg has a first end (61A, 62A) attached to an inner concentric ring (46), and a second end (61B, 62B) attached to a crossbar (65). The crossbar is attached to an outer concentric ring (48). A circular array of such brackets interconnects the two concentric rings (46, 48). Each leg has at least one curved middle portion (63, 64), such as an arcuate or sinusoidal curve at a midpoint on the length of each leg. This shape provides flexibility in a radial direction that accommodates differential thermal expansion of the concentric rings while providing a rigid connection in an axial direction.

16 Claims, 2 Drawing Sheets

(56) References Cited

U.S. PATENT DOCUMENTS

| | | | | |
|---|---|---|---|---|
| 2009/0188255 | A1* | 7/2009 | Green et al. | 60/737 |
| 2009/0293489 | A1* | 12/2009 | Tuthill et al. | 60/752 |
| 2010/0050640 | A1 | 3/2010 | Belsom et al. | |
| 2010/0089068 | A1* | 4/2010 | Ellis et al. | 60/796 |
| 2011/0061397 | A1* | 3/2011 | DiCintio | 60/796 |

* cited by examiner

THERMALLY COMPLIANT SUPPORT FOR A COMBUSTION SYSTEM

This application claims benefit of the 20 May 2011 filing date of U.S. application No. 61/488,207 which is incorporated by reference herein.

FIELD OF THE INVENTION

This invention relates generally to gas turbine engines and specifically to a gas turbine combustor cap assembly.

BACKGROUND OF THE INVENTION

A typical industrial gas turbine engine has a circular array of combustion chambers in a "can annular" configuration. Each combustion chamber has a cap assembly that holds a circular array of fuel/air premix tubes and a central pilot fuel tube. In some designs, a structural aspect of the cap assembly is a pair of concentric support rings that are interconnected by a circular array of brackets between them. The inner support ring surrounds and supports the premix tubes. The support rings are subjected to rapidly changing temperatures during cold starts and are also subjected to steady-state operational thermal gradients.

BRIEF DESCRIPTION OF THE DRAWINGS

The invention is explained in the following description in view of the drawings that show.

DETAILED DESCRIPTION OF THE INVENTION

Figure 1:
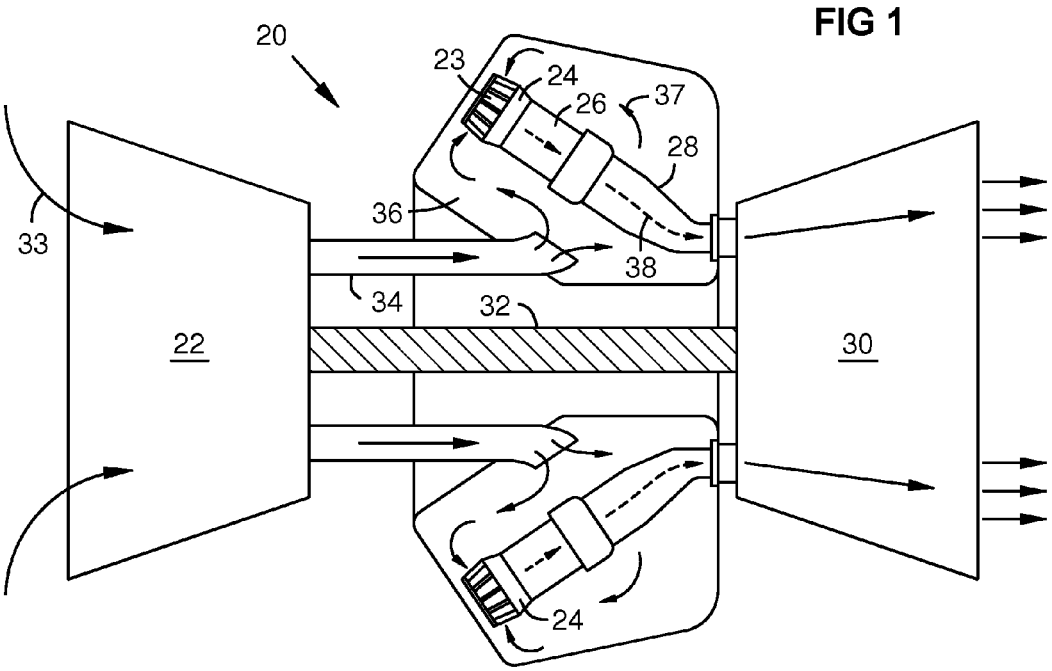
FIG. 1 is a schematic overview of an exemplary gas turbine engine within which embodiments of the invention may reside.

FIG. 1 shows a schematic overview of an exemplary gas turbine engine 20 that includes a compressor 22, combustor inlets 23, combustor cap assemblies 24, combustion chambers 26, transition ducts 28, a turbine 30 and a shaft 32 by which the turbine 30 drives the compressor 22. Several combustor assemblies 23, 24, 26, 28 may be arranged in a circular array in a can-annular design as shown. During operation, the compressor 22 intakes air 33 and provides a flow of compressed air 37 to the combustor inlets 23 via a diffuser 34 and a combustion system air plenum 36. Each combustor cap assembly 24 may contain fuel injectors that mix fuel with the compressed air. This mixture burns in the combustion chamber 26 producing hot combustion gasses 38 that pass through the transition duct 28 to the turbine 30. The diffuser 34 and the plenum 36 may encircle the shaft 32. The compressed airflow 37 in the combustion system plenum 36 has higher pressure than the working gas 38 in the combustion chamber 26 and in the transition duct 28.

Figure 2:
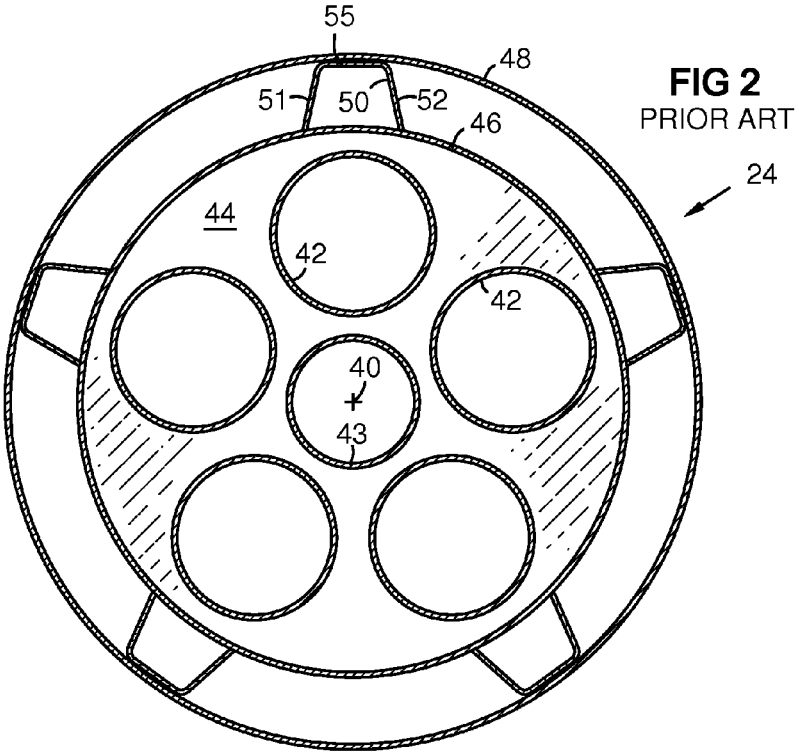
FIG 2 PRIOR ART
FIG. 2 is a sectional view of a prior combustor cap assembly.

FIG. 2 is a sectional view of a prior art combustor cap assembly 24 taken on a plane normal to the combustor centerline 40. A circular array of fuel/air premix tubes 42 and a central pilot fuel tube 43 may be attached to a plate 44 or other structure that in turn may be attached to an inner support ring 46. Inner support ring 46 may be attached to a concentric outer support ring 48 by a plurality of brackets 50 with first and second support legs 51, 52. Each bracket 50, including a crossbar 55 between the two support legs 51, 52, commonly has an isosceles trapezoidal geometry as shown. The legs 51, 52 may take the form of flat bars that rigidly transfer loads between the inner and outer support rings 46, 48.

The present inventors have recognized that the prior art brackets 50 provide a relatively stiff degree of support between the rings 46, 48 that does not readily accommodate operational thermal influences between the two rings 46, 48. Dissimilar thermal expansion of the rings 46, 48 produces cyclic and steady-state thermally induced loads on the brackets, which in turn allow large loads to be transferred between the rigidly attached combustion structures. These thermally induced loads may produce unintended component deformation, increased transient and steady state component stresses, and reduced static and dynamic environment combustion system capability. Thus, the present inventors have first recognized that the system performance may be enhanced by a support structure that is capable of providing a desired degree of axial stiffness while also providing some radial thermal expansion compliance.

Figure 3:
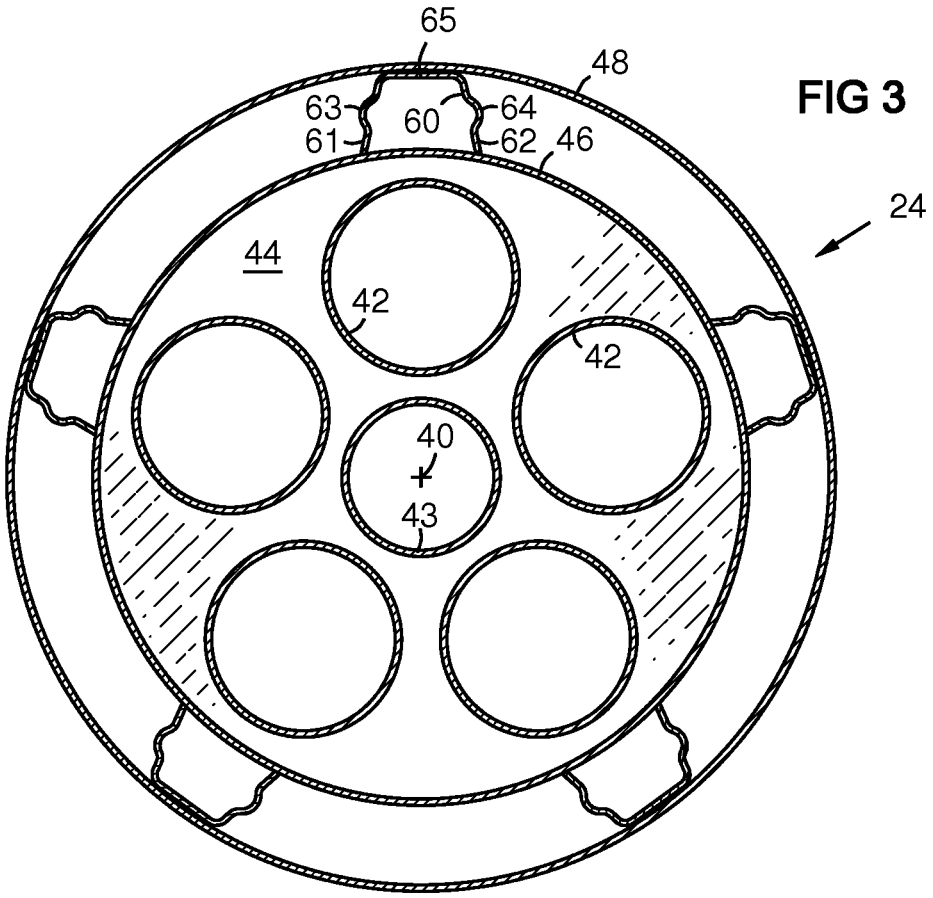
FIG. 3 is a sectional view of an exemplary combustor cap assembly according to aspects of the invention.

FIG. 3 is a sectional view of a combustor cap assembly 24 according to aspects of the invention. A circular array of fuel/air premix tubes 42 and a central pilot fuel tube 43 may be attached to a plate 44 or other structure that in turn may be attached to an inner support ring 46. Inner support ring 46 may be attached to a concentric outer support ring 48 by one or more exemplary brackets 60. Each bracket 60 may include first and second sidebars or legs 61, 62, each of which may take the form of a plate or bar. Each leg 61, 62 may include at least one curved portion such as at least one sinusoidal or arcuate departure 63, 64 from the generally planar shape of the leg between the ends of the legs 61, 62. The inner ends 61A, 62A of the respective legs 61, 62 may be attached to the inner support ring 46, for example, by welding. The outer ends 61B, 62B of the respective legs 61, 62 may be attached to the outer support ring 48 by means of a crossbar 65, for example, by bolting or welding. The brackets 60 may have a generally isosceles trapezoidal geometry as shown, in which the two legs 61, 62 follow two equal sides of an isosceles trapezoid. Trapezoidal geometry improves torsion resistance between the rings 46, 48 in contrast to rectangular geometry (not shown) or a single-leg bracket (not shown).

Figure 4:
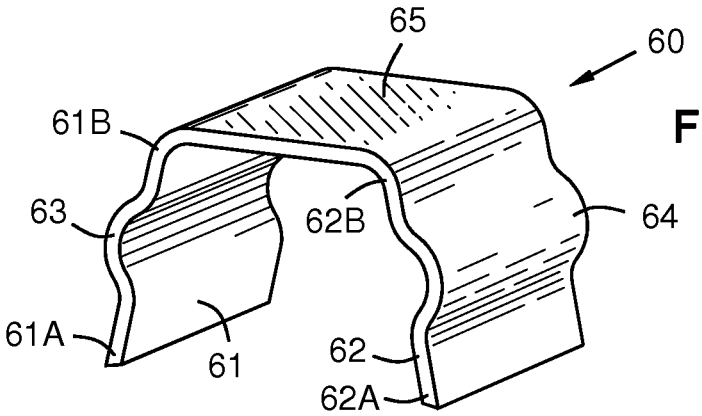
FIG. 4 is perspective view of an exemplary bracket according to aspects of the invention.

FIG. 4 is a perspective view of an exemplary bracket 60 in accordance with aspects of the invention. Each leg 61, 62 has a first end 61A, 62A, a second end 61B, 62B, and a single arcuate or half-sinusoidal departure 63, 64 between the first and second ends. The departure 63, 64 may form a curve in each leg, for example at midway or approximately midway along a span or length of each leg 61, 62. The departures 63, 64 may curve outward as shown and/or inward (not shown). This curve reduces stiffness in the radial direction, allowing relative thermal growth and contraction between the rings 46, 48, while maintaining system stiffness requirements in primary directions of dynamic excitations. "Radial" herein means perpendicular to the common axis of the concentric rings 46, 48, which normally coincides with the combustor centerline 40.

As may be appreciated by viewing FIGS. 3 and 4, the legs project a curvilinear shape when viewed in a direction parallel to the longitudinal axis (as viewed in FIG. 3), and they project a planar shape when viewed in a direction perpendicular to the longitudinal axis of the combustor (as might be seen if looking at the bracket from its side). This shape exhibits a relatively higher degree of stiffness in the longitudinal (axial) direction and a relatively lower degree of stiffness in the radial direction. In various embodiments the spring constant k (unit of force per unit of deflection) of the brackets 60 in the radial direction may be 50% or less of a prior art bracket of identical configuration but without the departures 63, 64 from a generally planar shape. In one embodiment, such brackets were effective to reduce the thermally induced loads by 38% during a fast start condition of a gas turbine engine.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A support structure in a gas turbine combustor cap, comprising;

a plurality of legs that each include a first end and a second end and span between a first structure and a second structure; and a crossbar attached to the second structure, wherein the second ends of the plurality of legs are attached to opposite sides of the crossbar, and wherein the crossbar comprises a generally planar surface between the opposite sides;

wherein each leg comprises a generally planar plate except having a curved section between the first and second ends of each leg effective to provide a degree of thermal expansion compliance between the first structure and the second structure.

2. The support structure of claim 1, wherein the plurality of legs span between an inner concentric ring structure and an outer concentric ring structure of the gas turbine combustor cap.

3. The support structure of claim 1, wherein each of the generally planar plates has a single arcuate or half-sinusoidal departure from a plane of the generally planar plate midway along a length of the generally planar plate.

4. The support structure of claim 3, wherein the plurality of legs comprises two legs attached to the crossbar in an overall sectional geometry of three sides of an isosceles trapezoid, wherein the two legs follow two equal sides of the isosceles trapezoid.

5. The support structure of claim 2, wherein each leg is shaped to exhibit a spring constant in a radial direction that is 50% or less of that of a planar leg of identical configuration but without the curved section.

6. A support structure in a gas turbine combustor cap, comprising:

an inner ring structure disposed within an outer ring structure about a longitudinal axis, wherein the outer ring structure is positioned within the gas turbine combustor cap of a combustor assembly;

a plurality of brackets attached between and interconnecting the inner ring structure and the outer ring structure in a radially spaced concentric relationship about the longitudinal axis;

the plurality of brackets comprising a plurality of legs, each leg projecting a planar shape when viewed in a direction perpendicular to the longitudinal axis and projecting a curvilinear shape when viewed in a direction parallel to the longitudinal axis.

7. The support structure of claim 6, wherein each leg is shaped to exhibit a spring constant in a radial direction that is 50% or less of that of a leg of identical configuration but not having the curvilinear shape.

8. A support structure in a gas turbine combustor cap, comprising;

a crossbar attached to an outer concentric ring of the gas turbine combustor cap; and first and second legs having respective ends extending from the crossbar and attached to an inner concentric ring of the gas turbine combustor cap;

wherein each leg comprises a shape exhibiting a relatively higher degree of stiffness in a longitudinal direction and a relatively lower degree of stiffness in a radial direction;

and wherein the respective ends of the first and second legs attached to the inner concentric ring are separated by a greater distance than the respective ends of the first and second legs extending from the crossbar.

9. The structure of claim 8, wherein each leg comprises an arcuate or sinusoidal curve at a midpoint on a length of the leg.

10. The structure of claim 9, wherein the arcuate or sinusoidal curve is a single outward arcuate or semi-sinusoidal curve.

11. The support structure of claim 1, wherein the crossbar is directly attached to the second structure.

12. The support structure of claim 1, wherein the plurality of legs terminate at the first ends, and wherein the first ends of the plurality of legs are spaced apart by a greater distance than the second ends of the plurality of legs.

13. The support structure of claim 12, wherein the curved section is positioned at a midpoint between the first and second ends of the plurality of legs.

14. The support structure of claim 6, wherein the inner ring structure is attached to a plate and wherein the plate is attached to a circular array of fuel air premix tubes and a central pilot fuel tube.

15. The support structure of claim 6, wherein the plurality of brackets each include a crossbar attached to the outer ring structure, wherein second ends of the plurality of legs are attached to opposite sides of the crossbar, and wherein the crossbar comprises a generally planar surface between the opposite sides.

16. The support structure of claim 1, wherein the first ends of the plurality of legs are attached to the first structure, wherein the first ends of the plurality of legs are separated by a greater distance than the second ends of the plurality of legs attached to the opposite sides of the crossbar.

* * * * *